US007069826B2

(12) United States Patent
Tilton

(10) Patent No.: US 7,069,826 B2
(45) Date of Patent: Jul. 4, 2006

(54) SCREWDRIVER ATTACHMENT

(76) Inventor: Mike Tilton, 1010 S. Whitman St. #212, Tacoma, WA (US) 98465

( * ) Notice: Subject to any disclaimer, the term of this patent is extended or adjusted under 35 U.S.C. 154(b) by 82 days.

(21) Appl. No.: 10/962,284

(22) Filed: Oct. 8, 2004

(65) Prior Publication Data

US 2006/0075856 A1 Apr. 13, 2006

(51) Int. Cl.
*B25B 23/10* (2006.01)

(52) U.S. Cl. ..... 81/457; 81/452

(58) Field of Classification Search ..... 81/451, 81/452, 456–458, 13

See application file for complete search history.

(56) References Cited

U.S. PATENT DOCUMENTS

| | | | | | |
|---|---|---|---|---|---|
| 99,781 | A | | 2/1870 | Martyn | |
| 845,978 | A | | 3/1907 | Rappelee | |
| 882,937 | A | * | 3/1908 | Fegley | 81/124.2 |
| 1,374,057 | A | * | 4/1921 | Carlin | 81/452 |
| 1,433,341 | A | * | 10/1922 | Cole | 81/453 |
| 1,593,233 | A | | 7/1926 | Wilson | |
| 1,641,307 | A | * | 9/1927 | Velepec | 81/457 |
| 1,698,521 | A | | 1/1929 | Wood | |
| 1,712,196 | A | | 5/1929 | Burger et al. | |
| 1,714,045 | A | * | 5/1929 | Pratt | 81/457 |
| 2,399,138 | A | * | 4/1946 | Nygaard | 81/452 |
| 2,406,952 | A | * | 9/1946 | Josepho | 81/452 |
| 2,566,673 | A | * | 9/1951 | Nygaard | 81/452 |
| 2,633,168 | A | | 3/1953 | Maheffey | |
| 2,782,823 | A | * | 2/1957 | Williams, Jr. | 81/451 |
| 3,182,697 | A | * | 5/1965 | Bonewits | 81/457 |
| 3,288,185 | A | | 11/1966 | Clark | |
| 3,298,410 | A | * | 1/1967 | Morifuji | 81/458 |

* cited by examiner

*Primary Examiner*—David B. Thomas
(74) *Attorney, Agent, or Firm*—Polly L. Oliver

(57) ABSTRACT

An attachment for drivers of screw type fasteners for releasably holding the fastener in place at the end thereof for inserting or removing. The attachment comprises a shaft collar, a spring, and a grasper, the grasper comprising an upper and a lower guide ferrule, joined concentrically by a pair of supports, and extending parallel from the lower ferrule a plurality of flexible fingers, each having at its distal end an inward facing detent that is substantially fulcrum shaped. The collar and spring are inserted between the ferrules, with the collar abutting the upper, the spring abutting the lower and the collar. A driver is inserted through the ferrules, collar, and spring until the tip is just shy of the detents, and the collar is then affixed to the driver shaft. A screw head is forced past the detents, the fingers yielding, and brought into proper contact with the driver tip, the fingers flexing back such that the detents hold the screw firmly to the driver.

20 Claims, 4 Drawing Sheets

SCREWDRIVER ATTACHMENT

FIELD OF THE INVENTION

This invention relates generally to tools, and more particularly to devices that are used to releasably hold fasteners in place at the ends of driving tools.

BACKGROUND OF THE INVENTION

Craftsmen, handymen, and other users of screw type fasteners have, since shortly after the invention of such fasteners, been frustrated by the difficulty posed by the need to occasionally install them in locations that are not easily accessed. Prior art is extensive, and in and of itself is evidence of the long held and widespread desire of artisans and the common handyman to devise a simple, inexpensive and versatile solution to this problem.

As early as 1870, U.S. Pat. No. 99,781 to Martyn demonstrates a solution that involves the employment of a cylindrical sleeve, actuated by a spring, to hold the screw in a favorable position with the driver head while the screw is driven, and to allow the sleeve to retract out of the way as the screw head comes into contact with the surface. U.S. Pat. No. 1,593,233 to Wilson in 1926 and U.S. Pat. No. 3,288,185 to Clark in 1966 are other examples of this approach. These devices are deficient in two basic ways. First, because the sleeve does not positively hold the screw to the driver head, the screw can fall free when the device is angled downward, and in all but an upward orientation the screw is so loosely in contact with the driver head that damage to the kerf is likely as the driving process occurs. Secondly, in order to work even reasonably well, the diameter of the sleeve must closely match the diameter of the screw head, necessitating multiple devices if it is to be used with a variety of screw sizes.

To overcome these deficiencies, inventors have employed a variety of remedies that involve flexible, resilient members that springably engage the screw head as a means of retaining it to the driver. U.S. Pat. No. 845,978 to Rappelee in 1907 employs a combination of a compression spring with a pair of screw holding jaws that are sleeved to the driver, the tips of said jaws being inwardly formed in a convex manner. This device, however, relies on a specifically modified driver and a permanent attachment of the device, the result being not only the requirement of a modification to the driving tool, but a modification that significantly weakens it. Additionally, the invention in no way envisions anything other than a device that must be permanently and specifically matched to the driver, thus eliminating the possibility of portability or minor adjustment to accommodate different fasteners.

U.S. Pat. No. 1,698,521 to Wood in 1929 combines the elements of a spring actuated guiding sleeve with springable fingers, said fingers being formed at the tips in a manner that lends itself to the retaining of a screw head. This invention, however, also relies on a driving tool that is specifically designed or modified to the requirements of the device, and as such is neither portable nor adjustable in the cause of dealing with different sizes and types of screws. Additionally, the sleeve, in order to be effective, as mentioned earlier, must closely match the diameter of the screw head. Furthermore, the sleeve presents an ineffective enclosure that prevents visual access to the driver head, thus making more difficult the alignment of the kerf with the driver head. Perhaps most significant of the drawbacks of this invention is its complexity, which involves the costly manufacture and assembly of multiple components that must have closely matched tolerances.

U.S. Pat. No. 1,712,196 to Burger et al. in 1929 features a sleeve with attached springable fingers, the tips of which are formed in a manner that allows for the insertion and retention of a screw head. The deficiencies of this invention are several. As with Wood, the sleeve not only has limited use unless its size is closely matched to that of the screw head, it presents an impediment to the visual alignment of the kerf with the screw head that often leads to the unnecessary and annoying need to "jockey" the two together. Additionally, though not as complex as Wood, it requires the costly manufacture and assembly of parts that demand close tolerances. Furthermore, this invention in no way envisions any means of actuation of the device on the driver other than manually sliding it to and fro, and therefore will not self grasp a fastener when it is being removed from a difficult to access location.

U.S. Pat. No. 2,633,168 to Mahaffey in 1953 describes a spring actuated cylinder with extending springable fingers, the tips of which are formed inward to allow for the retention of a screw head. This invention fails in several ways. It involves a fixed collar attached to the driver, abutting a spring, around which is formed a cylinder with extending fingers. Thus, a collar must be pressed or affixed in some manner at an exact location on the driver, and the cylinder formed around the collar and spring in such a manner that the collar is no longer accessible should it loosen, require minor adjustment, or it be desired to remove the entire device from the particular driver and install it on another. Additionally, the inwardly turned tips of the grasping fingers preclude the use of this device with flat head fasteners. Indeed, with virtually all head types except for round heads of a closely matched size, the invention performs poorly. Another criticism of this invention is that significant scarring of the surface is likely to occur as the screw is driven home and the tips of the fingers are forced outward by the force of the advancing screw.

OBJECTS AND ADVANTAGES

It is therefore an object of the present invention to provide a screwdriver attachment that will firmly hold a screw to the driver, even when the driver is pointed downward.

It is a further object of the invention to provide a screwdriver attachment that has an open architecture, thus enabling visual alignment of the driver tip with the kerf of the screw head.

It is another object of the invention to provide a screwdriver attachment that does not rely on modification of a driver.

It is yet another object of the invention to provide a screwdriver attachment that is readily installed onto and removed from a driver, and is easily adjustable to accommodate different screw head profiles.

It is still another object of the invention to provide a screwdriver attachment that does not require manual actuation.

An additional object of the invention is to provide a screwdriver attachment that results in minimal or no damage to the surface during insertion or removal of a screw.

It is yet a further object of the invention to provide a screwdriver attachment that does not rely on the costly manufacture and assembly of multiple parts with closely matched tolerances.

Other objects and advantages are that it is versatile in dealing with different screw heads, is lightweight, and is fun and easy to use.

Further objects and advantages of my invention will become apparent from a consideration of the drawings and ensuing description.

SUMMARY

The improved self-releasing, self-retaining fastener holding screwdriver attachment of the present invention comprises a grasping entity that includes a plurality of flexible fingers, at the ends of which are substantially fulcrum-shaped, inward-facing detents, the fingers being attached to a lower guide ferrule that is in turn joined to an upper guide ferrule by a pair of guide ferrule supports in such a way that a removable shaft collar and a compressive spring can be inserted between the two guide ferrules. A driver is then inserted through the ferrules, collar, and spring to a position where the driver head is just above the detents of the flexible fingers, and then is fixed in position by securing the collar to the driver shaft, typically with a set screw through the collar (however, other retention methods, such as clamping the collar to the shaft, could be used). A fastener is then inserted into the grasping entity, or grasper, by forcing it between the detents and into contact with the driver head, the flexible fingers having yielded to the urging of the spring such that the fastener head is above the lateral land of the detents and is firmly held against them by the opposing force of the driver and the flexural force of the fingers. In use, it will be seen that the force applied to driving in a fastener will overcome both the flexion of the fingers and the urging of the spring and will release the fastener as the head comes into contact with the surface.

Conversely, in removing an embedded fastener, a sufficient force applied to the driver will part the fingers and allow the driver head to be inserted into the fastener head, and as the fastener is removed and the head moves away from the surface, the spring will force the grasper down so that the fastener head passes between the lands of the detents and is thus captured by the combined forces of the flexible fingers and the urging of the of the driver against the detents.

The inventive concept is embodied in several alternatives. In one alternate embodiment, more than one detent per finger is used. This arrangement of detents can be used to hold the screw more firmly within the grasper or to imbed the screw to a predetermined offset height from the surface. In other alternate embodiments, the second detent (referred to herein as the upper detent) can be shaped to match different types of screw heads so as to hold these screws more tightly. In this way, the grasper can be tailored for a specific type of installation. Still another alternate embodiment replaces the compressive spring with magnets for providing the urging force for actuating the invention.

DETAILED DESCRIPTION

Figure 1:
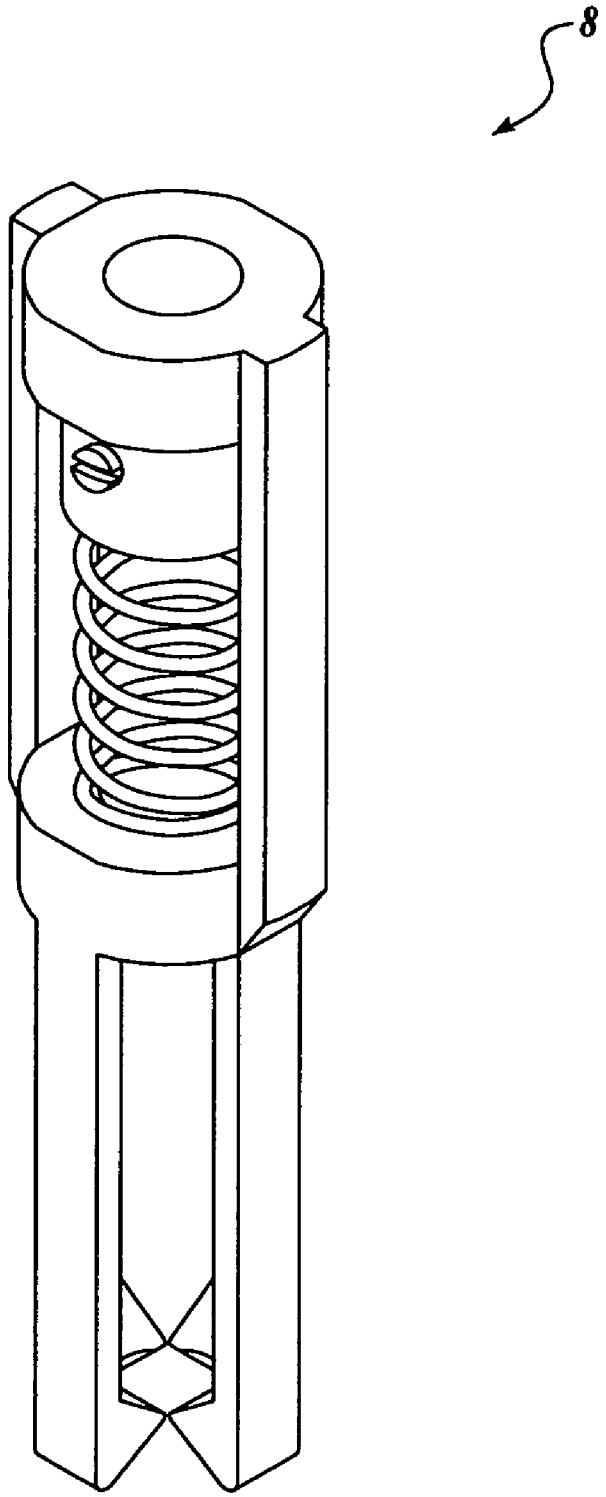
FIG. 1 is a perspective view of one embodiment of the invention.

FIG. 1 is a perspective view of the invention of the screwdriver attachment 8 designed for the purpose of retaining a screw to a screwdriver, the screwdriver having a handle (not shown), a shaft 16, and a tip at its distal end. Alternatively, the invention 8 could be used on a screwdriver with a shaft and a driving bit mounted on the distal end of the shaft.

Figure 2:
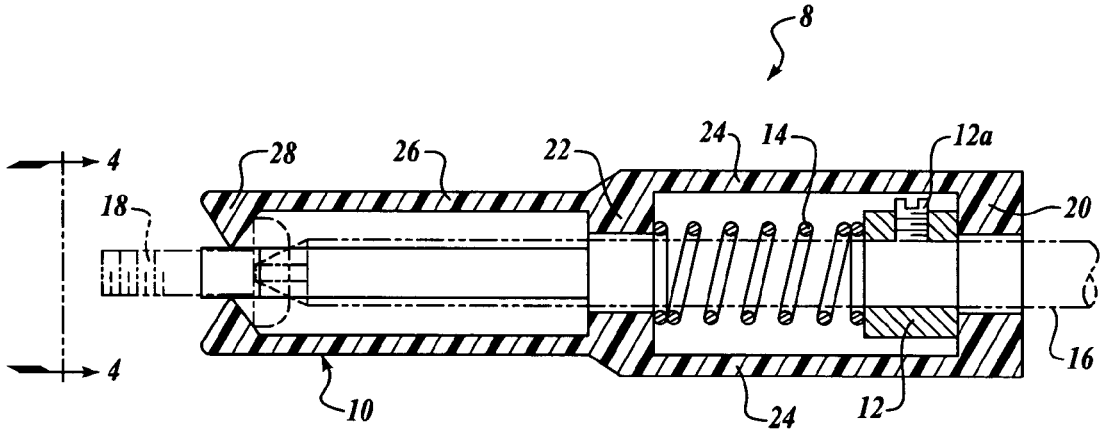
FIG. 2 is a side view in partial cross section of the invention attached to a driver with a screw retained.

FIG. 2 shows a side view in partial cross section of the preferred embodiment of the present invention 8 in which a driver 16, of such a type as is typical and well known, has assembled upon it a grasping entity, or grasper 10, a shaft collar 12 with set screw 12*a*, and a compression spring 14. (It is understood from the invention summary above that alternate collar retention methods could be used, such as clamping a two-piece collar around the shaft.) A typical fastener 18 is shown in a retained position. The grasper 10 comprises an upper guide ferrule 20 connected to a lower guide ferrule 22 by a pair of opposing guide ferrule supports 24, both guide ferrules 20 and 22 circumscribing the shaft. Through the centers of guide ferrules 20 and 22 are holes 21 (best shown in FIG. 4) having a diameter sufficient to allow the driver shaft 16 to pass through without restriction. The distance between the guide ferrules 20 and 22 is determined such that when the spring 14 and the collar 12 are inserted between the two in alignment, the spring 14 will be under slight compression and will urge the upper guide ferrule against the collar. Extending parallel to said supports 24 and generally perpendicular from the lower guide ferrule 22 in the direction opposite the upper guide ferrule, is a plurality of flexible fingers 26, each having at its distal end an inward facing detent 28. It is envisioned that, by virtue of regulating the dimensions of the component parts, the entire grasper 10 will be formed of a durable yet flexible and resilient plastic or composite material, or formed sheet metal, as to provide it with a reasonable working life, and preferably of a material that lends itself to such economic manufacture as injection molding or such. It is understood, however, that any material may be used, and in any combination, that offers a satisfactory end result.

Figure 3A:
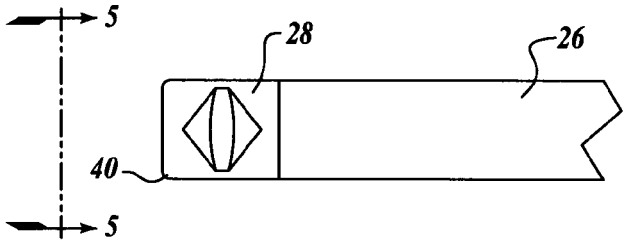
FIG. 3A is a front view detail of a flexible finger and detent.

FIG. 3A is a front view of one typical and representative finger 26 and detent 28 in which it is shown that the first bottom corners 40 of the detent are rounded.

Figure 3B:
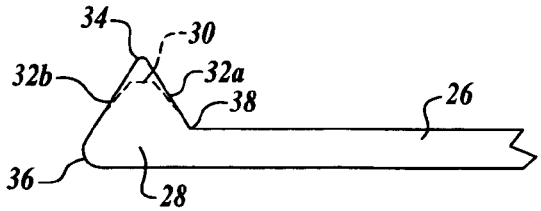
FIG. 3B is a side view detail of the flexible finger and detent.

FIG. 3B shows a side view of one typical and representative finger 26, including the detent 28. It is shown that the detent 28 defines at least one bevel (preferably two) that slopes at angles 32*a* and 32*b* from the finger 26 to a rounded land 34, said land also being made concave 30 along its lateral face such that the concavity extends partly into the slopes 32*a* and 32*b*. It is also shown that the second bottom corner 36 of the detent 28 is rounded, as is the upper and inner corner 38.

Figure 4:
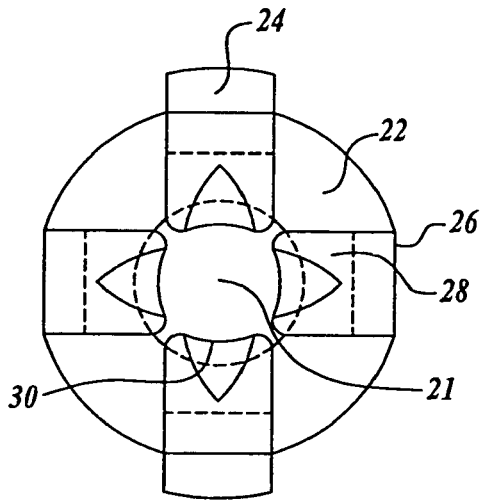
FIG. 4 is a bottom view taken along line 4—4 of FIG. 2.

FIG. 4 shows a bottom view of FIG. 2 in which the narrow and compact nature of the invention is evident. Depicted here are the guide ferrule supports 24, the fingers 26, and their respective detents 28 in end view. Also depicted is the manner in which the detents 28 are closed in to each other at rest, thus giving maximum retention force, and that the lateral faces 30 of the lands 34 are slightly concave in order to afford maximum surface contact with the fastener 18 for the means of stability. The holes 21 through the guide ferrules 20 and 22 are shown in this figure. It can be seen how all of the elements of the attachment 8 are in alignment—generally concentric—and are mounted generally coaxially around the shaft of the driver 16.

Figure 5:
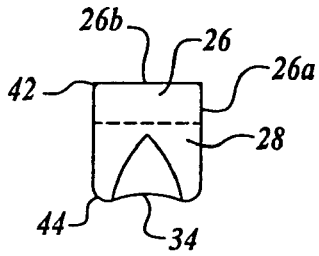
FIG. 5 is a bottom view taken along line 5—5 of FIG. 3A.

In FIG. 5 it is shown that the third bottom corners 42 of the detent 28 are rounded, as are the outer corners 44 of the land 34. It is also shown that the front profile 26*b* of the finger 26 is greater in width than that of the side profile 26*a*, thus providing lateral stability and resistance to the torsional twisting that occurs when the detents 28 are pinched between the screw head and the surface during the final phase of insertion.

As is shown in the preceding figures, all of the detent and land corners 36, 38, 40, 42, and 44 are rounded. It is not necessary to the function of the invention; however, such rounding helps to properly seat the fastener and also to reduce or eliminate any scratching and marking of the surface.

Figure 6:
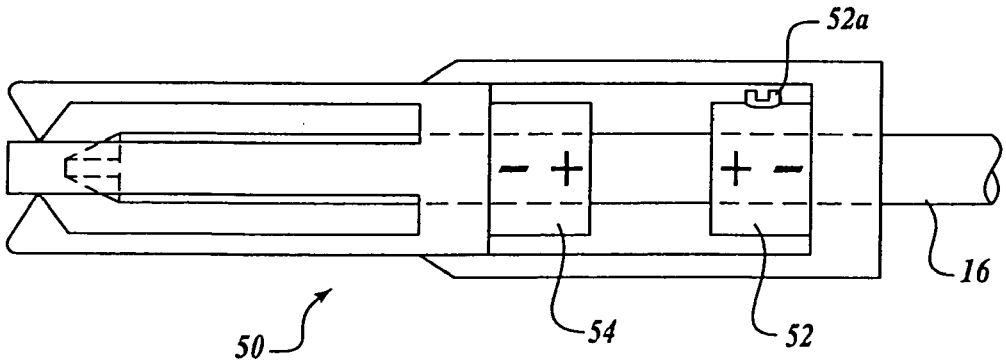
FIG. 6 is a partially cutaway side view of a first alternate embodiment.

FIG. 6 shows a side view of an alternate embodiment in which the invention consists of a grasper 50, a first magnetic shaft collar 52 with set screw 52*a*, and a second opposing magnetic collar 54, all mounted around the shaft of a driver 16. The driver is inserted through the grasper 50, the magnetic shaft collar 52, and the opposing magnetic collar 54, the collars being arranged such that their magnetic fields repel (example shown). When the driver tip or driving bit is in proper position just shy of the detents, the magnetic shaft collar 52 is affixed to the shaft of the driver using the set screw 52*a*, adjacent the upper guide ferrule. It will thus be seen that the opposing magnetic fields of the collars, which are oriented to repel one another, will provide an urging means that will actuate the invention in the same manner as the compression spring in the preferred embodiment, i.e., urging the lower guide ferrule toward the tip of the screwdriver and the upper guide ferrule against the first collar.

Figure 7:
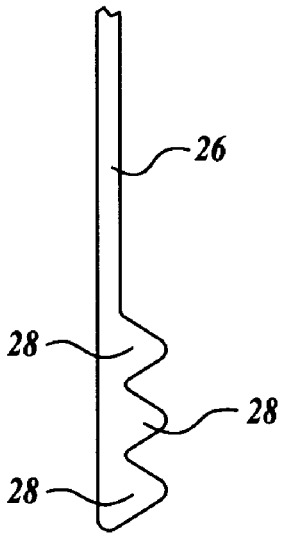
FIG. 7 is a side view of the finger and detents of a second alternate embodiment.

FIG. 7 shows a side view of a second alternate embodiment in which each finger 26 has a plurality of similarly-shaped detents 28, each next to the other, and spaced inwardly of the end detent toward the lower guide ferrule. It is thus possible to use this embodiment not only in the same manner as the preferred embodiment, but also to use the invention to drive a screw 18 to a position whereby the head is left a certain distance from the surface. In doing this, the grasper 10 is secured to the driver 16 such that the tip of the driver is positioned to receive a screw 18 above a chosen detent 28. Limited by the travel of the spring 14 to total compression and the length of the fingers 26 that extend away from the chosen detent, the insertion of the screw 18 will end with the head of the screw a predetermined distance away from the surface.

The remaining figures show how in alternate embodiments, the second, upper detent may be shaped to fit a particular type of screw head—such as flat, pan, or round—thereby allowing that the screw is held more tightly within the grasper.

Figure 8:
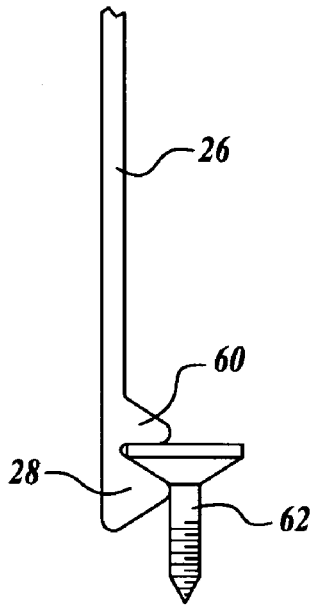
FIG. 8 is a side view of the finger and detents of a third alternate embodiment.

FIG. 8 shows a side view of a third alternate embodiment in which each finger 26 has at its end a detent 28, and adjacent to it a flat head upper detent 60 which is shaped such that it matches the surface contour of a flat head screw 62. Due to the increased surface area of contact between the flat head screw 62 and the grasper 10 provided by the flat head upper detent 60, the screw is held more firmly.

Figure 9:
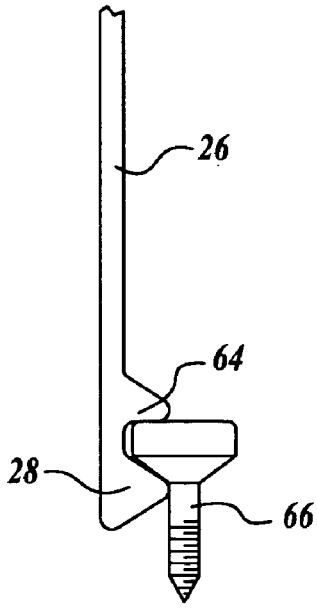
FIG. 9 is a side view of the finger and detents of a fourth alternate embodiment.

FIG. 9 shows a side view of a fourth alternate embodiment in which each finger 26 has at its end a detent 28, and adjacent to it a pan head upper detent 64 which is shaped such that it matches the surface contour of a pan head screw 66. As with the flat head in the previous embodiment, the increased area of contact results in the screw being held more firmly.

Figure 10:
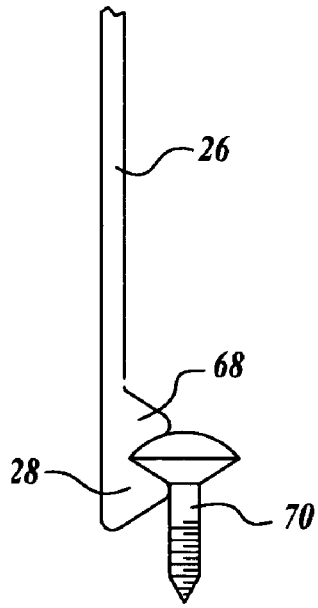
FIG. 10 is a side view of the finger and detents of a fifth alternate embodiment.

FIG. 10 shows a side view of a fifth alternate embodiment in which each finger 26 has at its end a detent 28, and adjacent to it a round head upper detent 68 which is shaped such that it matches the surface contour of a round head screw 70. As with the other embodiments featuring upper detents, the screw is held more firmly.

OPERATION

Having thus the completed grasper 10, the collar 12 is placed abutting the upper guide ferrule 20, which is oriented toward the screwdriver handle, and the set screw 12*a* is tightened therethrough. Then the spring 14 is inserted, under slight compression, between and abutting the collar 12 and the lower guide ferrule 22, which is oriented toward the screwdriver tip. The driver 16 is then inserted through the hole 21 in the upper guide ferrule, through the spring 14, through the hole 21 in the lower guide ferrule, and through the area between the fingers 26 until the driver head approaches the detents 28.

A typical screw 18 is then pressed into the lower slopes 32*b* of the detents, the screw head being centered and guided by the concave contour 30 of the detents, until the force of the screw head against the bottom slopes 32*b* of the detents overcomes the flexural resistance of the fingers 26, thus forcing the detents 28 momentarily apart and allowing the screw head to pass between them into a position above the lands 34 of the detents. If the particular grasper being used has a shaped upper detent—such as the one for flat head screw 62, pan head screw 66, or round head screw 70—then the screw will be firmly seated between the detents. The driver 16 is then inserted into the kerf of the screw 18 and is used to force the screw head down firmly against the upper slopes 32*a*. While then holding the driver 16 and the grasper 10 firmly in relation to each other, the set screw 12*a* in collar 12 is tightened until the collar is fixed to the driver shaft.

In driving the screw 18 into a surface, the driver 16 is either manually or by some mechanism rotated axially. The grasper 10 rotates with the driver 16 until the screw 18 is advanced (driven in) to such a point that the second bottom corners 36 of the detents 28 come into contact with the surface. At that point, rotational slippage occurs between the grasper 10, the collar 12, and driver 16, the result being that as the screw 18 is driven home the grasper does not continue to rotate. In conjunction with the rounding of the first bottom corners 40 and the second bottom corners 36 of the detents 28, this minimizes or eliminates scarring of the surrounding surface. In completing the driving home of the screw, enough axial force is provided that the driver 16 is forced into the screw head, which forces the screw head against the upper slopes 32*a* of the detents 28, said force overcoming the compression strength of the spring 14 and the flexural strength of the fingers 26 such that the detents 28 are forced out and up out of the way, releasing the screw 18 and allowing the screw head to fully contact the surface into the desired seated position.

In removing an embedded screw, the invention is placed so that the detents 28 surround the screw head. Due to the fact that the detents, when the invention is in its rested state, extend out and beyond the end of the driver, and due to their shape, individually and in concert, this is reasonably accomplished even when the user cannot visually guide the process. Once the detents 28 are in a surrounding position, the driver tip 16 is forced by the user towards the screw head and into the kerf, overcoming the compression of the spring 14. While maintaining pressure on the driver, the user axially rotates the driver and screw until the screw head, pushing against the lower slopes 32*b* of the detents 28, yet resisted by the compressive strength of the spring 14, induces flexion in the fingers 26, thus spreading the detents 28 apart and allowing the screw head to pass beyond the lands 34 of the detents. As this occurs, the flexural strength of the fingers, aided by the angle of the upper slopes 32*a* of the detents, overcomes the lessening compression strength of the spring, allowing the detents 28 to close in. By virtue of the flexural properties of the fingers 26 forcing the upper slopes 32*a* into the underside of the screw head, joined by the slight residual pressure of the spring providing an upward force of the detents against the underside of the screw head, the screw is firmly captured.

The successful performance of the screwdriver attachment 8 relies on a balance of forces acting in concert with each other. Primarily, they involve the compressive properties of the spring 14, the flexural properties of the fingers 26, and the angles of the slopes 32*a* and 32*b* of the detents 28. Though these properties are perhaps more properly discussed in the static description, it is thought that an explanation of the operation of the invention would facilitate the matter. As noted in the operation of the invention, the spring will have characteristics such that under slight compression it will provide upward force of the upper slopes 32*a* against the underside of a retained screw head in approximate balance with inward force provided by the flexural property of the fingers in order to firmly hold a retained screw. As compression of the spring increases, as when the driver head is forced in the direction of the detents during either the final driving home of the screw, or when it is desired to capture an embedded one, the force it exerts increases, as is true of the characteristics of compression springs. And similarly, the flexural force exerted by the fingers 26 increases with the degree of deflection, and is governed by the length, thickness, width, and type of material. In that it is desired to have both an inward force supplied by the flexural fingers 26 and an upward force against the screw head supplied by the compressive spring 14 when a screw is in a retained position, and that the spring must, at the point when the screw head must pass through the lands 34 of the detents 28 during release or capture, have a force greater than that of the fingers 26 to allow the detents 28 to part and make way, and that the angle of the slopes 32*a* and 32*b* have a governing influence in vectoring these forces, the successful operation of the invention depends on the consideration and balance of all of these factors during construction.

CONCLUSION, RAMIFICATIONS, AND SCOPE

Thus the reader will see that the invention provides a solution to a long expressed need in a way that is very inexpensive to produce, is adaptable to a variety of currently marketed drivers, is versatile in addressing a variety of screw head sizes and types, is easily removed or moved out of the way when it is not required, will not cause damage to surfaces during use, is highly functional and reliable, and is elegant in its simplicity.

While my above description contains many specifics, these should not be construed as limitations on the scope of the invention, but rather as an exemplification of one preferred embodiment thereof. Many other variations are possible. For example, the grasper can be made in different sizes to accommodate an even wider variety of fastener sizes, and colored differently as a means of distinguishing them; the number and orientation of the fingers can be varied so that they better conform to the needs of such things as hex head fasteners, etc.

Thus the scope of the invention should be determined by the appended claims and their legal equivalents, rather than by the examples given.

What is claimed is:

1. A screwdriver attachment for retaining a screw to a screwdriver, the screwdriver having a handle, a shaft and a tip, comprising:

a grasper mounted generally co-axially around the shaft of said screwdriver, said grasper having an upper guide ferrule circumscribing said shaft and a lower guide ferrule circumscribing said shaft, said ferrules being connected by a pair of opposing guide ferrule supports, said grasper also comprising a plurality of fingers mounted to and extending away from the lower guide ferrule in the direction opposite the upper guide ferrule;

a collar with set screw, mounted around said shaft and adjacent said upper guide ferrule, said set screw being tightened against the shaft so as to retain said collar on said shaft; and a compression spring retained within said grasper and mounted between said collar and said lower guide ferrule, said spring being generally coaxial with said shaft and capable of urging said upper guide ferrule against said collar.

2. The screwdriver attachment of claim 1 wherein said grasper is made of material selected from the group including plastics, composites, and formed sheet metal.

3. The screwdriver attachment of claim 2 wherein there are four fingers and said fingers define substantially fulcrum-shaped inward-facing detents at their distal ends.

4. The screwdriver attachment of claim 3 wherein the fingers are relatively flexible and are capable of providing flexural resistance when forced apart.

5. The screwdriver attachment of claim 4 wherein each of said fulcrum-shaped detents defines at least one bevel that slopes at an angle from the finger to a rounded land spaced inwardly from the finger and having a lateral face thereon.

6. The screwdriver attachment of claim 5 wherein each of said fulcrum-shaped detents defines two bevels, each of which slopes at an angle from the finger to a rounded land spaced inwardly from the finger and having a lateral face thereon.

7. The screwdriver attachment of claim 6 wherein said land defines a concavity along said lateral face such that the concavity extends partly into said bevel.

8. The screwdriver attachment of claim 7 wherein each finger further comprises a second upper shaped detent spaced between said detent and said lower guide ferrule.

9. The screwdriver attachment of claim 2 wherein there are three fingers and said fingers define substantially fulcrum-shaped inward-facing detents at their distal ends.

10. The screwdriver attachment of claim 2 wherein each finger defines a second upper detent spaced toward the lower guide ferrule.

11. A screwdriver attachment for use on a typical screwdriver having a handle, a shaft, and driving bit, comprising:

a grasper mounted generally co-axially around the shaft of said screwdriver, said grasper having an upper guide ferrule circumscribing said shaft and a lower guide ferrule circumscribing said shaft, said ferrules being connected by a pair of opposing guide ferrule supports, said grasper also comprising a plurality of fingers mounted to and extending away from the lower guide ferrule in the direction opposite the upper guide ferrule;

a first magnetic shaft collar with set screw, mounted around said shaft and adjacent said upper guide ferrule, said set screw being tightened against the shaft so as to retain said collar on said shaft; and a second opposing magnetic shaft collar retained within said grasper and mounted between said first collar and said lower guide ferrule, said collars being oriented to repel one another so that they are capable of urging said upper guide ferrule against said first collar.

12. The screwdriver attachment of claim 11 wherein said grasper is made of material selected from the group including plastics, composites, and formed sheet metal.

13. The screwdriver attachment of claim 12 wherein there are four relatively flexible fingers capable of providing flexural resistance when forced apart and said fingers define substantially fulcrum-shaped inward-facing detents at their distal ends.

14. The screwdriver attachment of claim 13 wherein each of said detents defines a bevel that slopes at an angle from the finger to a rounded land spaced inwardly from the finger and having a lateral face thereon.

15. The screwdriver attachment of claim 14 wherein said land defines a concavity along said lateral face such that the concavity extends partly into said bevel.

16. The screwdriver attachment of claim 15 wherein each finger further comprises a second upper shaped detent spaced between said detent and said lower guide ferrule.

17. The screwdriver attachment of claim 15 wherein the upper guide ferrule is mounted around the shaft towards the handle of the screwdriver and the fingers extend beyond the tip of the shaft.

18. The screwdriver attachment of claim 17 wherein the magnetic field generated by the first and second shaft collars urges the lower guide ferrule toward the tip of the screwdriver so that the upper guide ferrule is forced against the first collar.

19. A method of using a screwdriver attachment on a screwdriver shaft, said screwdriver also having a handle and a tip, for aligning and retaining a screw to be driven, said attachment comprising a grasper with upper and lower guide ferrules connected by guide ferrule supports and a plurality of flexible fingers extending from the lower guide ferrule and having detents at the distal ends thereof, a collar with set screw therethrough, and a compression spring, said method comprising the steps of:

mounting the grasper on the screwdriver shaft by tightening the set screw through the collar adjacent the upper guide ferrule, and positioning the spring between the collar and the lower guide ferrule, with the upper guide ferrule toward the screwdriver handle and the lower guide ferrule toward the screwdriver tip;

pressing the screw to be driven within the detents of the grasper by temporarily forcing apart the detents of the flexible fingers to accommodate the passage of the screw head;

placing the screw in contact with the surface to be driven in the location desired;

axially rotating the screwdriver so as to advance the screw into the surface; and driving the screw home by providing enough axial force to urge the screw head beyond the detents and into the desired seated position.

20. A method of using a screwdriver attachment on a screwdriver shaft, said screwdriver also having a handle and a tip, for removing an installed screw of the type having a screwhead with kerf, said attachment comprising a grasper with upper and lower guide ferrules connected by guide ferrule supports and a plurality of flexible fingers extending from the lower guide ferrule and having detents at the distal ends thereof, a collar with set screw therethrough, and a compression spring, said method comprising the steps of:

mounting the grasper on the screwdriver shaft by tightening the set screw through the collar adjacent the upper guide ferrule, and positioning the spring between the collar and the lower guide ferrule, with the upper guide ferrule toward the screwdriver handle and the lower guide ferrule toward the screwdriver tip;

placing the grasper adjacent the screw head with the detents of the flexible fingers proximate the driven surface and the screwdriver tip fitted within the kerf of the screwhead;

axially rotating the screwdriver so as to retract the screwhead beyond the detents and retract the screw into the grasper; and removing the screw from the grasper.

* * * * *